US009615984B2

(12) United States Patent
Trabucco

(10) Patent No.: US 9,615,984 B2
(45) Date of Patent: Apr. 11, 2017

(54) TREATMENT OF CHRONIC BACK PAIN USING A THREE-DIMENSIONAL MONOFILAMENT MATTRESS OVERLAY

(71) Applicants: Herniamesh S.R.L., Chivasso (IT); Angela Trabucco, Muttontown, NY (US)

(72) Inventor: Ermanno E. Trabucco, Muttontown, NY (US)

(73) Assignee: HERNIAMESH S.R.L., Chivasso (IT)

( * ) Notice: Subject to any disclaimer, the term of this patent is extended or adjusted under 35 U.S.C. 154(b) by 0 days.

(21) Appl. No.: 14/204,237

(22) Filed: Mar. 11, 2014

(65) Prior Publication Data

US 2015/0257953 A1 Sep. 17, 2015

(51) Int. Cl.
*A61G 7/05* (2006.01)
*A61G 7/057* (2006.01)

(52) U.S. Cl.
CPC ..... *A61G 7/05* (2013.01); *A61G 7/057* (2013.01)

(58) Field of Classification Search
CPC ..... A61G 7/05; A61G 7/057
USPC ..... 5/691
See application file for complete search history.

(56) References Cited

U.S. PATENT DOCUMENTS 5,231,717 A * 8/1993 Scott et al. ..... 5/727
5,906,879 A * 5/1999 Huntoon ..... A61F 13/15731 264/103
6,052,851 A * 4/2000 Kohnle ..... 5/690
6,272,707 B1 8/2001 Robrecht et al.
6,966,088 B1 11/2005 Hu
8,166,589 B2 5/2012 Hijlkema
2004/0062910 A1* 4/2004 Morrison ..... 428/137
2006/0168736 A1 8/2006 Meyer et al.
2007/0059496 A1* 3/2007 Russell ..... A61F 13/5323 428/188
2007/0238935 A1* 10/2007 Boyd ..... 600/300
(Continued)

FOREIGN PATENT DOCUMENTS

WO 92/08398 A1 5/1992
WO 93/09749 A1 5/1993
WO 2008/061228 A2 5/2008

OTHER PUBLICATIONS

Pota, Vincenzo et al., The Low-Back Pain: From Pathophysiology to Clinical Practice, Sep. 2013, Pain Nursin Magazine—Italian Online Journal vol. 2—N. 3 2013: pp. 148-151.*
(Continued)

*Primary Examiner* — David E Sosnowski
*Assistant Examiner* — Myles Throop
(74) *Attorney, Agent, or Firm* — Troutman Sanders LLP

(57) ABSTRACT

A method of treating the back pain of a patient which can include the steps of weighing the patient, selecting a firmness of a mattress based on the patient's weight, and disposing a three-dimensional fabric overlay over the mattress for use by the patient. To select the mattress, it can be determined if the weight of the patient corresponds to a value and if the weight is less than or equal to the value, a firm mattress is selected, and selecting a soft mattress if the weight is greater than the value. Further, the overlay can have a plurality air spaces provided between an upper layer, a lower layer and a plurality of monofilaments in the overlay. The plurality of air spaces can be allowed to partially collapse under the weight of the patient.

14 Claims, 8 Drawing Sheets

(56) References Cited

U.S. PATENT DOCUMENTS

| | | | | |
|---|---|---|---|---|
| 2010/0186172 | A1* | 7/2010 | Dennis et al. | 5/740 |
| 2010/0308846 | A1* | 12/2010 | Camus | 324/679 |
| 2011/0041254 | A1* | 2/2011 | Howell | 5/689 |
| 2011/0047708 | A1* | 3/2011 | Rensink et al. | 5/706 |
| 2011/0173757 | A1* | 7/2011 | Rensink et al. | 5/698 |
| 2013/0283530 | A1* | 10/2013 | Main et al. | 5/600 |
| 2014/0096325 | A1* | 4/2014 | Giannopoulos | 5/691 |

OTHER PUBLICATIONS

Cassino, R., et al, A controlled, randomized study on the effect iveness of two overlays in the treatment of decubitus ulcers, Edizioni Minerva Medica, Feb. 2013.

Cassino, R., et al, Comparison of Two Mattress Overlays in the Prevent Ion of Pressure Ulcers, Edizioni Minerva Medica, Mar. 2013.

Ricci, E., et al., A randomized study on the effectiveness of a New Pressure-Relieving Mattress Overlay . . . , The EWMA Journal, vol. 13, No. 1, Apr. 2013, pp. 27-32.

Pota, V., et al., Low back pain: from pathophysiology to clinical practice, Pain Nursing Magazine—Italian Online Journal, Sep. 2013.

Find the mattress that fits your body. FloBeds. Oct. 17, 2012 [retrieved from the Internet, May 15, 2015] <<https://web.archive.org/web/20121017033201/http://www.flobeds.com/build-bed/>-bed/>>.

* cited by examiner

TREATMENT OF CHRONIC BACK PAIN USING A THREE-DIMENSIONAL MONOFILAMENT MATTRESS OVERLAY

FIELD OF THE INVENTION

The invention relates to a three-dimensional monofilament mattress overlay used to treat chronic back pain.

BACKGROUND

The treatment or prevention of bed sores (i.e. pressure ulcers or decubitus ulcers) is an ongoing field of study. Special mattresses or mattress overlays have been used to reduce or prevent the development of these ulcers. They typically form on patients who are bedridden and unable to move or move frequently from one position to the next. The pressure ulcer can be defined as localised damage to the skin and/or underlying tissues usually situated on a bony prominence and deriving from pressure or pressure combined with the force of friction.

Multiple products have been developed to treat this disorder. These include mattresses/overlays formed from standard foam, compound foam, gel, fibre, air, water, spheres, and natural fleece, and alternating pressure mattresses/overlays, fluidised beds, and air-release beds. Other support surfaces can be used like bed rotation, re-positioning of operative surfaces, pillows, and protection for bony prominences. Two notable products in this area are the Akton® viscoelastic mattress overlay and the Aiartex® mattress overlay.

The Akton® viscoelastic mattress overlay is about 15.9 mm thick and is one of the most widely used pressure relieving device for the prevention of pressure ulcers, especially in the United States. The mattress overlay is made of 100% Akton viscoelastic polymer which is a vulcanized cross-linked rubber material with the ability to maintain its shape, stretch, deflect an applied load and absorb shock. The mattress overlay weights 35 kg.

The Aiartex® mattress overlay is a CE-marked class 1 medical device currently used in the treatment and prevention of pressure ulcers and is a macro-porous three-dimensional material (9 mm thick) entirely made in flame retardant polyester. FIG. 1 illustrates an example of Aiartex® 100 which consists of two parallel and superimposed layers (upper layer 102 and lower layer 104) connected by transversal suspensory monofilaments 106. It is highly porous (with pores 110 larger than one millimeter on the upper layer 102) and elastic, with complete return to its original shape after decompression. Small, interconnected air spaces 108 are formed between the upper and lower layers 102, 104 by the spacing of the monofilaments 106, which provide continuous ventilation of the skin while improving load distribution with a reduction of pressure peaks. The upper layer 102 is soft, made of multi-filament, and drains any exudates and conveys them to the lower layer 104 by capillarity and gravity through the transversal monofilaments 106. This action keeps the skin dry and aerated which prevents maceration. The intermediate transversal layer 106 and the lower layer 104 are both made of monofilament. The mattress overlay 100 weighs approximately 800 g and can weigh 850 g.

While it is known that mattress overlays can prevent bedsores there is little research to see if they can prevent any other ailments, including back pain. It is known that certain mattresses or support pillows can aid with both bed sores and muscle pain (see, U.S. Pat. Nos. 8,166,589 and 6,966, 088) but either they are complete mattresses which are complex and expensive or partial solutions which do not allow the user to change position. What is needed is a simple mattress overlay to allow a user to adapt an existing mattress and also allow a full range of movement.

SUMMARY

Thus, the present examples of the invention provide a method of treating the back pain of a patient. The method can include the steps of weighing the patient, selecting a firmness of a mattress based on the patient's weight, and disposing a three-dimensional fabric overlay over the mattress for use by the patient. To select the mattress, it can be determined if the weight of the patient corresponds to a value and if the weight is less than or equal to the value, a firm mattress is selected, and selecting a soft mattress if the weight is greater than the value. In an example, the value can be approximately 80 Kg.

The three-dimensional fabric overlay can include an upper layer, a lower layer, and monofilaments disposed between the upper layer and the lower layer. Further, the overlay can have pores in the upper layer that allow moisture to travel through the pores from the upper layer to the lower layer, and away from the patient. A plurality air spaces can be provided between the upper layer, the lower layer and the plurality of monofilaments and the plurality of air spaces can be allowed to partially collapse under the weight of the patient. In an example, the plurality of air spaces can be prevented from fully collapsing by at least providing rigid monofilaments. The monofilaments can have a length of approximately 8 mm to 14 mm, and in one example, approximately 9 mm.

The three-dimensional fabric overlay can have a weight of about 800 g to 850 g and can be removed and replaced over the mattress. In certain configurations, the three-dimensional fabric overlay is disposed only over a top of the mattress, or approximately an entire portion of the top of the mattress.

BRIEF DESCRIPTION OF THE DRAWINGS

This invention is described with particularity in the appended claims. The above and further aspects of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Lower back pain affects millions of people worldwide. Some estimates state that it affects about 40% of people at some point in their lives. Lower back pain (or Low Back Pain—often abbreviated as LBP) may be classified by duration as acute (pain lasting less than 6 weeks), subchronic (6 to 12 weeks), or chronic (more than 12 weeks). The condition may be further classified by the underlying cause as mechanical, non-mechanical, or referred pain.

LBP is a disease related to several factors: physical as in the case of scoliosis, spinal compression or muscle fatigue, but also psychological and social. Experts see LBP as somewhat of a sign, suggesting that something in the spinal column is not quite as it should be. The most common cause is tension generated by incorrect posture. 56% of cases involve the lumbar-sacral segment, presumably due to the advent of the personal computer, keeping us in front of a monitor for many hours a day. When a patient adopts an incorrect posture for too long, the body learns to compensate for any ill-easiness, but these "corrections" can, in turn, cause problems to the tendons of the legs or the spinal column itself. Further, being overweight is considered a joint cause of LBP.

There are several remedies for LBP. At a time when the cause has been identified postures must be corrected immediately, intervening when necessary, by physical means, analgesics and anti-inflammatory medications. In the case of treatment failure, a patient can consider a surgical evaluation. While there is scientific evidence on pharmacological treatment of LBP there is very little evidence regarding the biomechanics of load weight, rest and posture, as well as for the specific media used while the patient is resting.

Here, the use of a three-dimensional multi and monofilament mattress overlay can help alleviate the patient's LBP when lying down in any position (prone, supine, or lateral, etc.).

Figure 1:
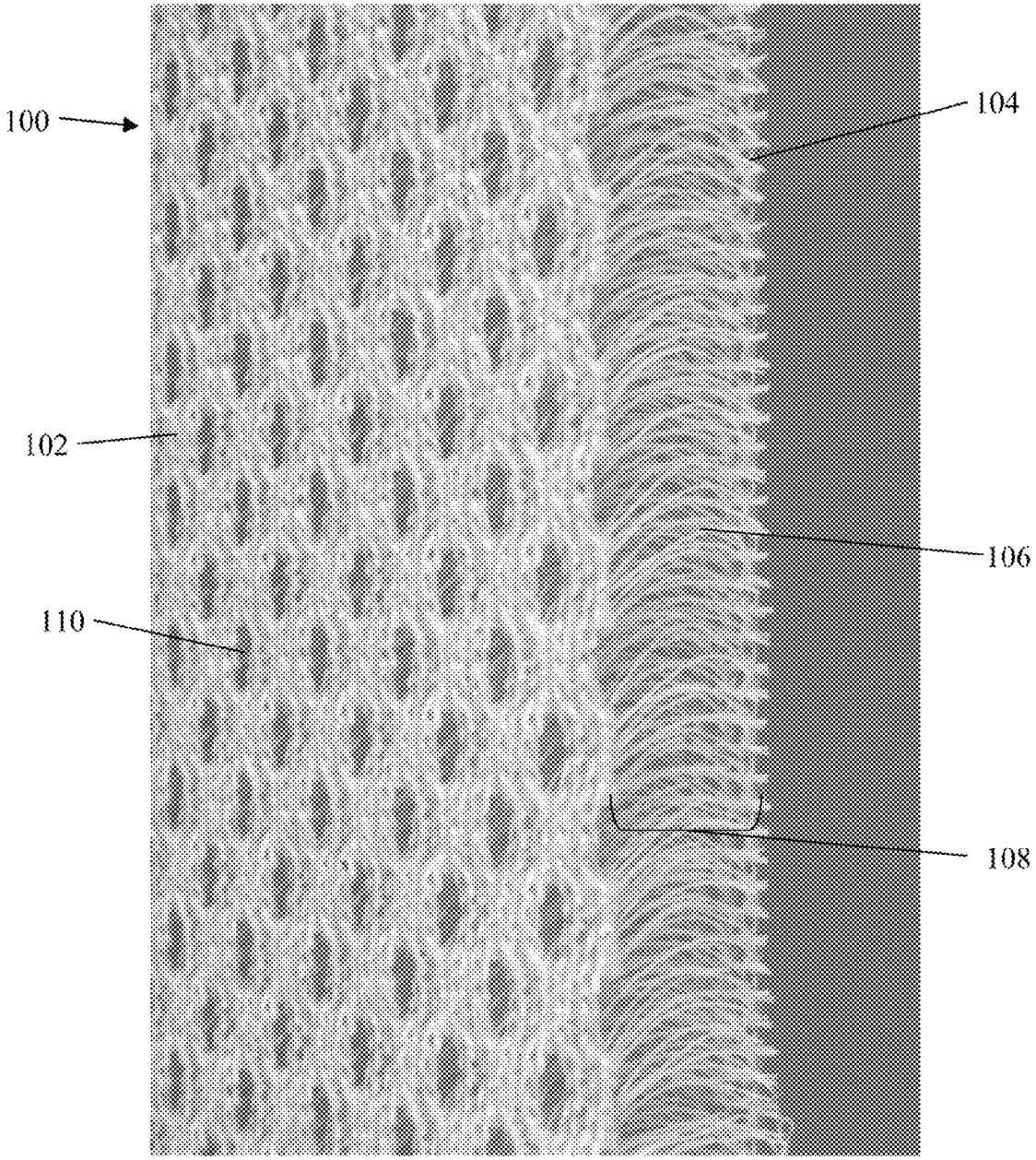
FIG. 1 is a top-side prospective cross-section of the Aiartex® mattress overlay.
Figure 2A:
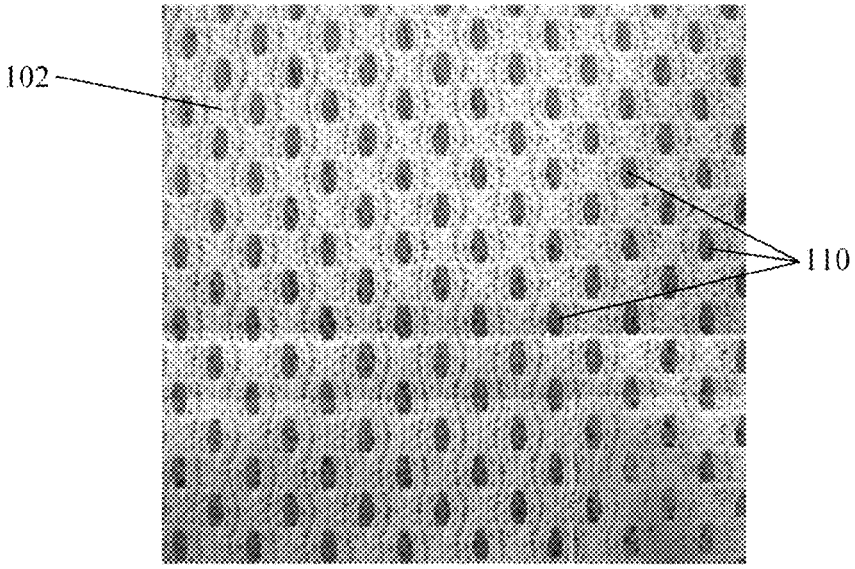
FIG. 2A is a top view of the Aiartex® mattress overlay.
Figure 2B:
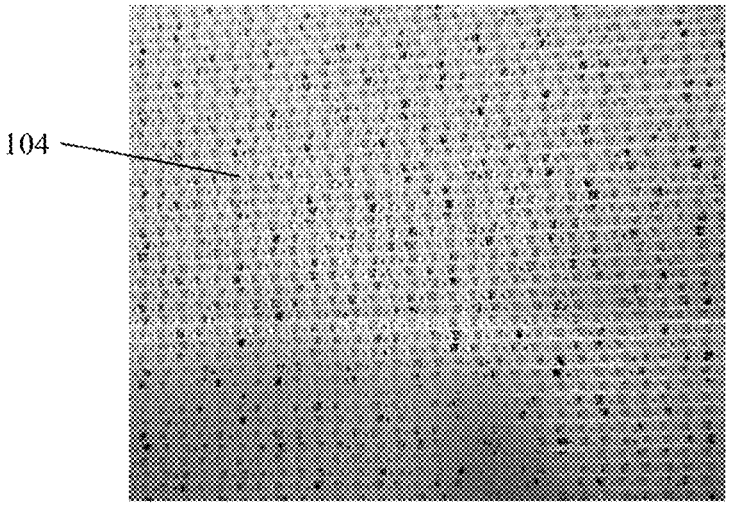
FIG. 2B is a bottom view of the Aiartex® mattress overlay.
Figure 2C:
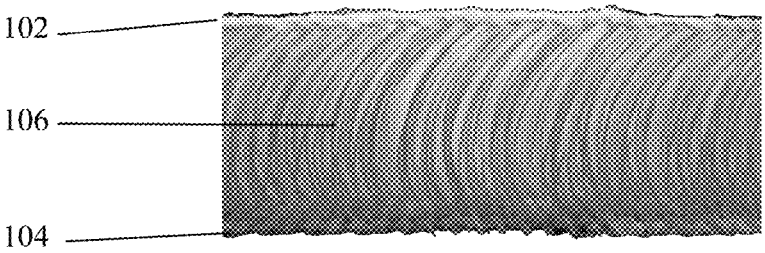
FIG. 2C is a side cross-section view of the Aiartex® mattress overlay.

Turning first to the construction of the overlay 100, FIG. 2A illustrates upper layer 102 with pores 110. The upper layer 102 can be formed from polyester, and, in one example, the upper layer 102 can be formed from a PES (polyethersulfone) monofilament. The diameter of the monofilament can vary between about 0.10 to about 0.14 mm, and in one example is 0.12 mm. FIG. 2B illustrates lower layer 104. The lower layer 104 can be formed from polyester, and, in one example, formed from a PES multifilament. The PES multifilament can be, in an example, 167/36 dtex textured title. FIG. 2C illustrates the monofilaments 106 spanning between the upper and lower layers 102, 104. The monofilaments 106 can be formed from PES and have a diameter between about 0.10 to about 0.14 mm, and in one example is 0.12 mm. Further, the upper layer 102, lower layer 104, and the monofilaments 106 can be flame retardant.

Figure 3:
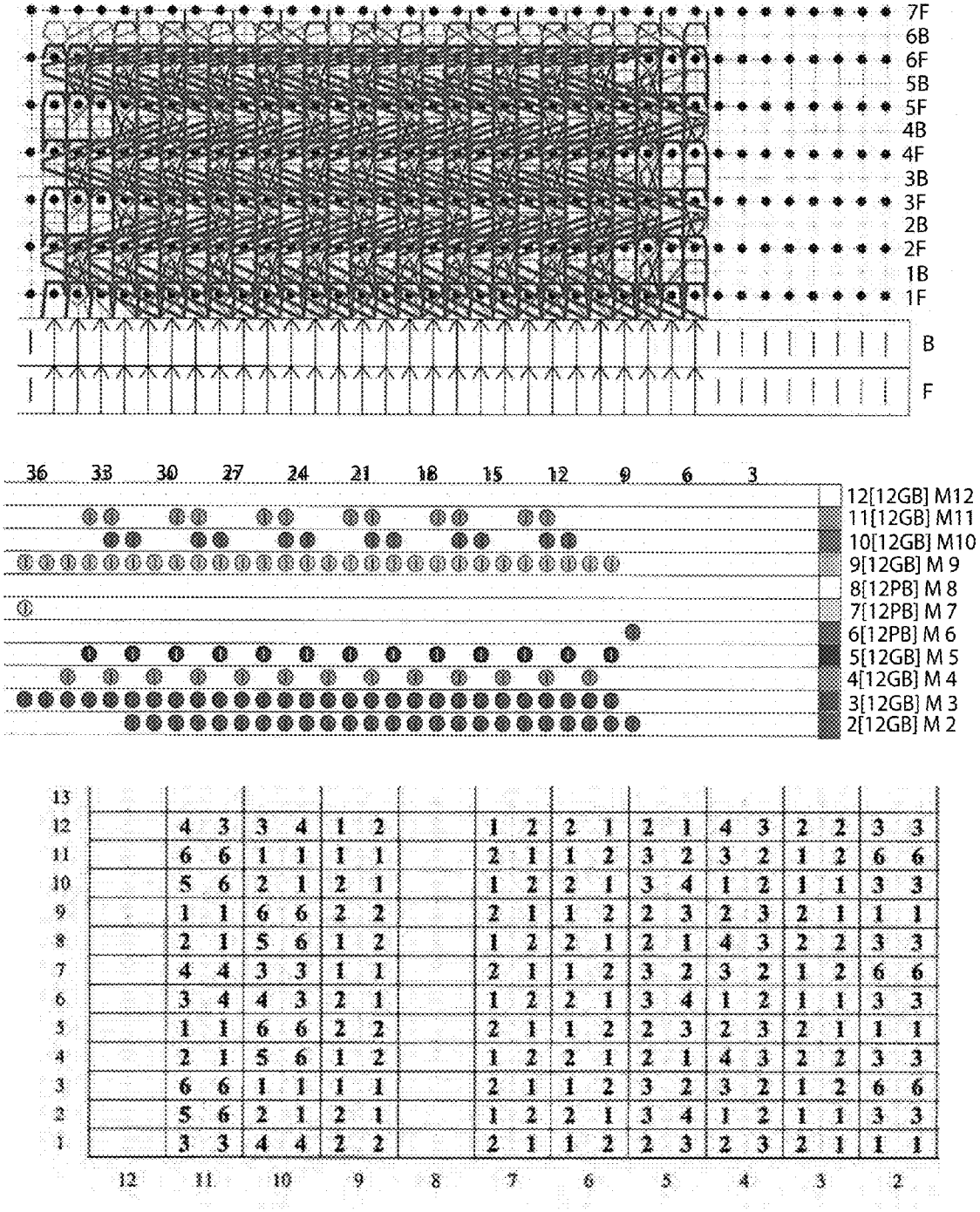
FIG. 3 illustrates a weaving pattern for an example of the three-dimensional fabric.

The fabric itself 100 can be woven with a gauge of, for example, 16 needles per inch (n.p.i.) and a point density of 9-10 stitches/cm. This can result in a thickness of the fabric 100 of about 8 mm to about 15 mm. Past a length of 0.15 mm the monofilaments 106 become too long and lose some of their rigidity. In an example, the fabric 100 can be 14 mm, 9 mm, and 9 mm±1 mm. A length of approximately 9 mm, in one example, provided enough length to remain rigid but long enough to allow a partial collapse under the weight of an average patient. Further, this can result in a weight of the fabric 100 of approximately 525 g/m$^2$±10%. FIG. 3 illustrates the weaving pattern for an example of the three-dimensional fabric. Here rigid, in one example, can be used to describe that the monofilaments 106 remain approximately straight when not under weight of the patient, bend under the weight of the patient, and then return to their original position once the weight is removed. The bending of the monofilaments 106 can cause the air spaces 108 to be reduced in size, as the distance between the upper and lower layers 102, 104 is reduced. See FIG. 3 for a weaving pattern for an example of the fabric 100.

Figure 4A:
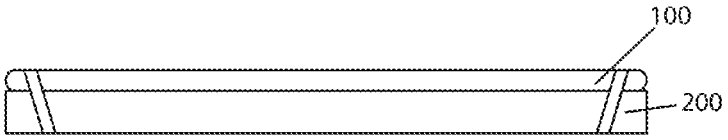
FIG. 4A is a side view of the mattress overlay.
Figure 4B:
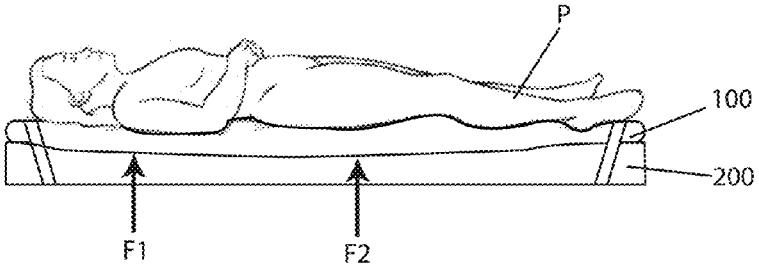
FIG. 4B is a side view of the mattress overlay in use.

Turning now to the method of treatment, FIGS. 4A and 4B illustrates the fabric 100 can be placed over mattress 200. When a patient P lies down on the fabric overlay 100, it compresses, but not completely. FIG. 4B illustrates a typical patient P in the supine position. In this position, the patent P experiences at least two high pressure points F1, F2, typically at the shoulders F1 and hips F2. Further, the fabric overlay 100 remains partially in the gap formed by the curve of the spine to provide some support. The fabric overlay 100 cushions the pressure points F1, F2 because the interconnected air spaces 108 partially collapse and act to distribute the pressure. In addition, the wicking effect of the fabric 100 draws moisture (e.g. sweat) away from the patient P which increases the patient's comfort and reducing the discomfort associated with changing positions.

Figure 4C:
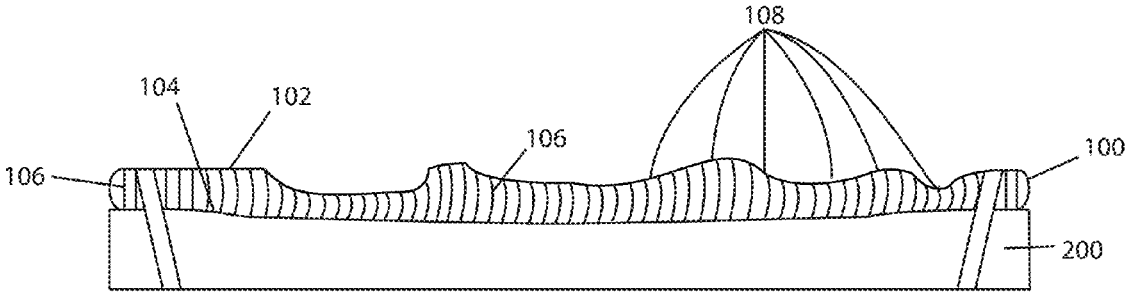
FIG. 4C is a side cross-section view of the mattress overlay partially collapsed.

In an example, one of the factors in comforting the patient P is the fact that the air spaces 108 do not completely collapse. The monofilaments 106 are rigid between the two soft upper and lower layers 102, 104. See FIG. 4C. Keeping the air spaces 108 from complete collapse is a function of the monofilaments 106, the weight of the patient, and the firmness of the mattress 200. For patients less than or equal to about 80 Kg, a firmer mattress helps keep the patient P supported and give enough of a base to allow the fabric 100 to collapse instead of the mattress absorbing most of the pressure. For patients greater than about 80 Kg, a softer mattress is required. Here, too firm of a mattress 200 allows the weight of the patient P to fully collapse the air spaces 108. The softer mattress allows the mattress to absorb some of the weight from the heavier patient P, resulting in the partial collapse of the air spaces 108. The fabric 100 can also support the patient P in the lateral and prone positions with the same effectiveness.

Figure 5A:
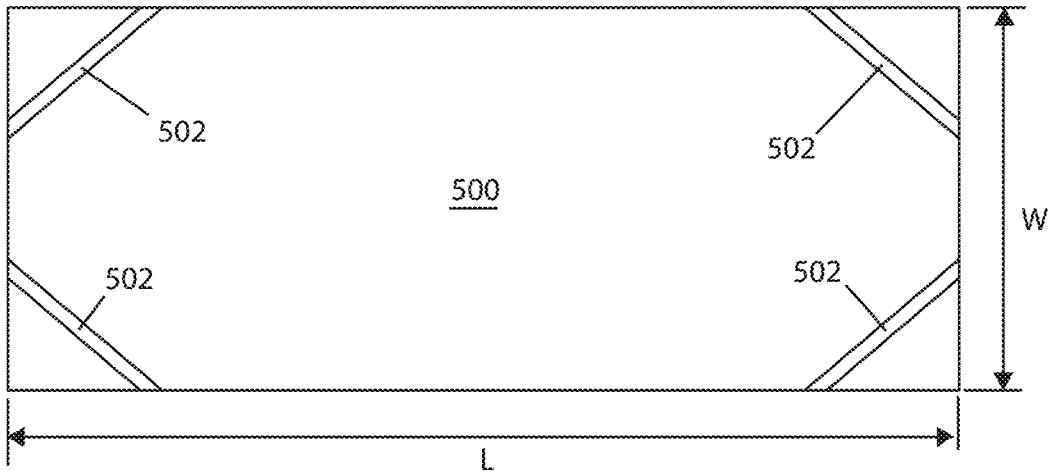
FIG. 5A is a bottom view of another example of a mattress overlay.
Figure 5B:
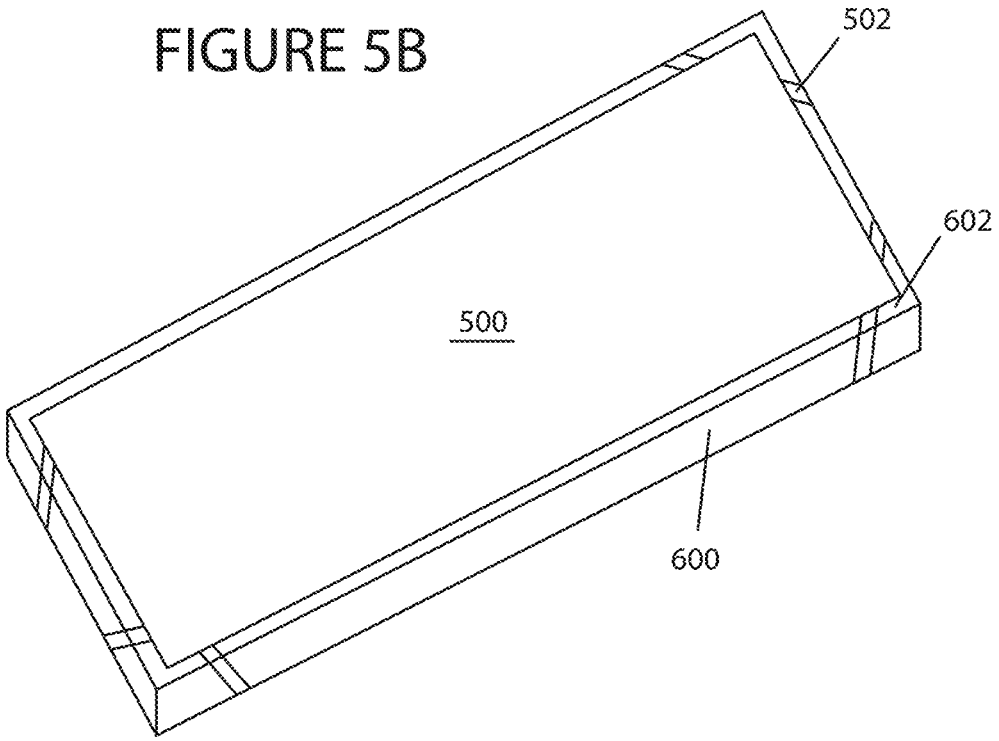
FIG. 5B is a top-right perspective view of a mattress overlay disposed on a mattress.

FIG. 5A illustrates an example of a full mattress overlay 500. The mattress overlay 500 can be sized to fit standard mattress 600 sizes including twin, twin extra long, full, full extra long, queen, king, and California king. In one example, the mattress overlay 500 can have a length L and a width W. The length L can be approximately 1950 mm and the width W can be approximately 900 mm. In these examples, the mattress overlay 500 can be sized to fit the top or approximately the entire top 602 of the mattress 600. See, FIG. 5B. The mattress overlay 500 can be secured and removed from the mattress 600 using a number of methods known to those of skill in the art, including one or more elastic corner straps 502. The removability allows the mattress overlay 500 to be cleaned using conventional methods and then returned to the mattress 600.

A study was performed to illustrate an example of the present invention. The study was reported in the article, *The Low-Back Pain: From Pathophysiology To Clinical Practice*, Pota, Vincenzo et al., Pain Nursin Magazine—Italian Online Journal Vol. 2-N. 3 2013: pp 148-151 (September 2013). The study included 40 patients with chronic LBP. The inclusion criteria was an average pain VAS>50 mm, pain duration longer than 3 months, and not currently on drug therapy or the presence of drug therapy with a stable dose for at least a month prior to the study. The VAS is a "Visual Analog Scale" that allows a patient to self-report the amount of a stimulus they experience. The pain VAS ("Pain") in this study was a measure of pain the patient was experiencing. The pain VAS in the study consisted of a linear scale 100 mm in length where zero corresponds to no pain and 100 the worst pain imaginable.

The patients were divided into 2 groups, Group A, which included 20 patients, were provided a three-dimensional mattress overlay 100 and Group B was a control group of 20 patients. The characteristics of the patients in each group are below in Table 1.

TABLE 1

Characteristics of patients

| | Group A (N = 20) | Group B (N = 20) | p Value |
|---|---|---|---|
| Age (±SD) | 56.2 (±8.4) | 56.4 (±7.7) | 0.5 |
| Male/Female | 6/14 | 7/13 | 0.5 |
| Average weight Kg (±SD) | 75.4 (±9.4) | 75.6 (±9.3) | 0.6 |
| Average VAS (±SD) | 65 mm (±8) | 62 mm (±9.7) | 0.1 |

The patients in both groups had an enrollment visit (V0) and were then called for a follow-up visit after one month (V1), and after 2 months (V2). The patients were measured on their Pain score, the quality of their sleep ("Sleep") and a Patients' Global Impression of Change ("PGIC") scale. Sleep quality was assessed using a linear scale of 100 mm VAS where zero is similar to the ideal continuous and restful sleep and 100 is the worse sleep. The PGIC questionnaire was used to assess the impact of treatment on the patient's quality of life and ability to carry out daily activities, with a score from 1 (no change or worsening of conditions) to 7 (major change and significant improvement in variables cited above). The results are tabulated in Table 2.

TABLE 2

Changes in effectiveness parameters

| | Group A (N = 20) | Group B (N = 20) | p Value |
|---|---|---|---|
| Pain (V0) | 65 (±8) | 62 (±9.7) | p > 0.05 |
| Pain (V1) | 24 (±8) | 62 (±9.7) | p > 0.05 |
| Pain (V2) | 20 (±6.3) | 63 (±7.8) | p > 0.05 |
| Sleep (V0) | 75.5 (±5) | 74.6 (±6) | p > 0.05 |
| Sleep (V1) | 20 (±6.3) | 73 (±6.4) | p > 0.05 |

TABLE 2-continued

Changes in effectiveness parameters

| | Group A (N = 20) | Group B (N = 20) | p Value |
|---|---|---|---|
| Sleep (V2) | 17 (±4.5) | 72 (±7.4) | p > 0.05 |
| PGIC (V1) | 6.6 (±0.6) | 1.4 (±0.6) | p > 0.05 |
| PGIC (V2) | 6.8 (±0.4) | 1.4 (±0.6) | p > 0.05 |

Figure 6:
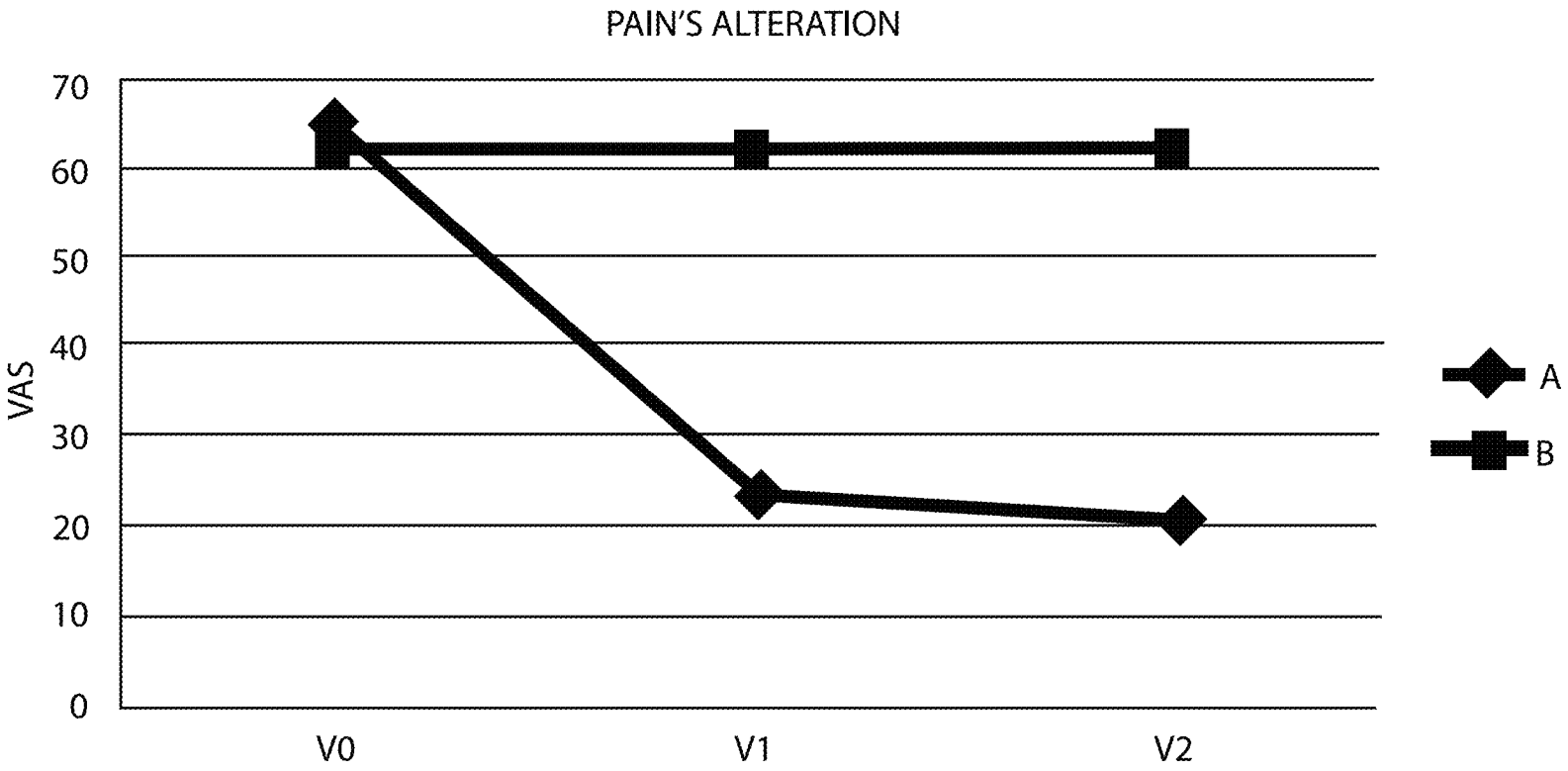
FIG. 6 is a graph of the change in reported pain by the patients in an example.
Figure 7:
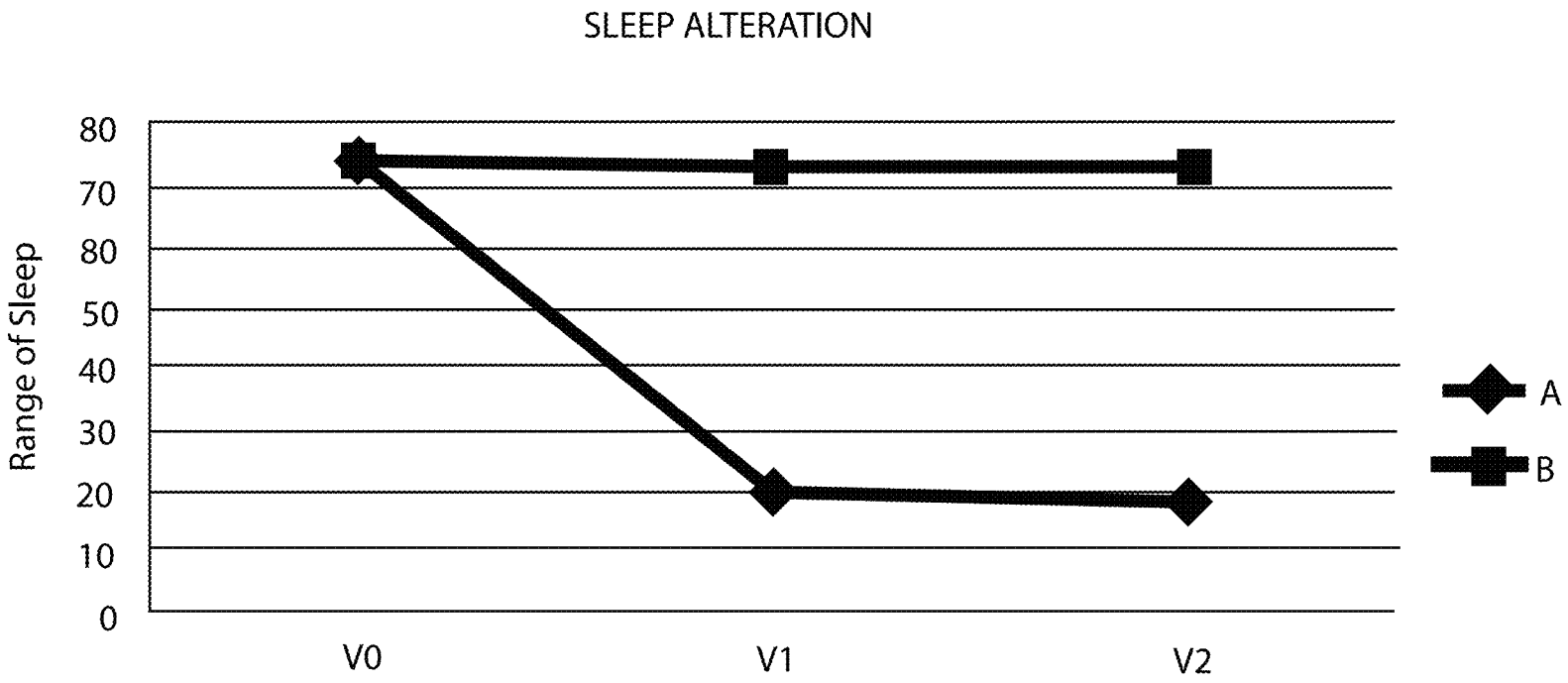
FIG. 7 is a graph of the change the quality of sleep as reported by patients in an example.

The results from the first-month check-up (V1) were significant, there was a reduction in pain of 50% compared to the control group (Pain Group A: 24±8 vs. Pain Group B: 62±9.7). The quality of sleep improved more than 50% for the patients in Group A (Sleep Group A: 20±6.3 vs. Sleep Group B: 73±6.4). See FIGS. 6 and 7.

At the two-month check-up (V2), improvement in both the pain related result (Pain Group A: 20±6.3 vs. Pain Group B: 63±7.8) and the quality of sleep (Sleep Group A: 17±4.5 vs. Sleep Group B: 72±7.4) was seen. The impact analysis of using a three-dimensional mattress overlay on the quality of life showed a significant improvement in the 20 patients treated with respect to the control group (PGIC Group A: 6.8+0.4 vs. PGIC Group B: 1.4±0.6).

Figure 8A:
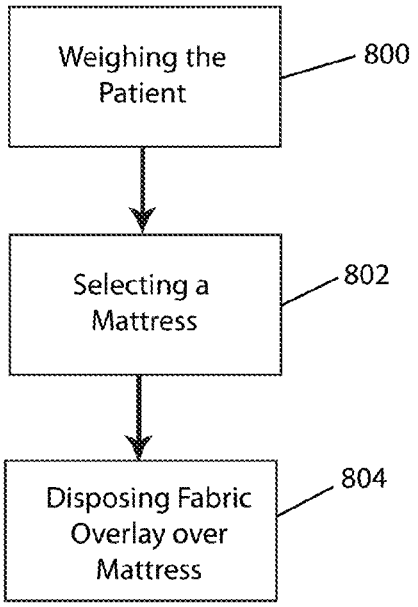
FIGS. 8A and 8B are flow charts for examples of methods of treating back pain.
Figure 8B:
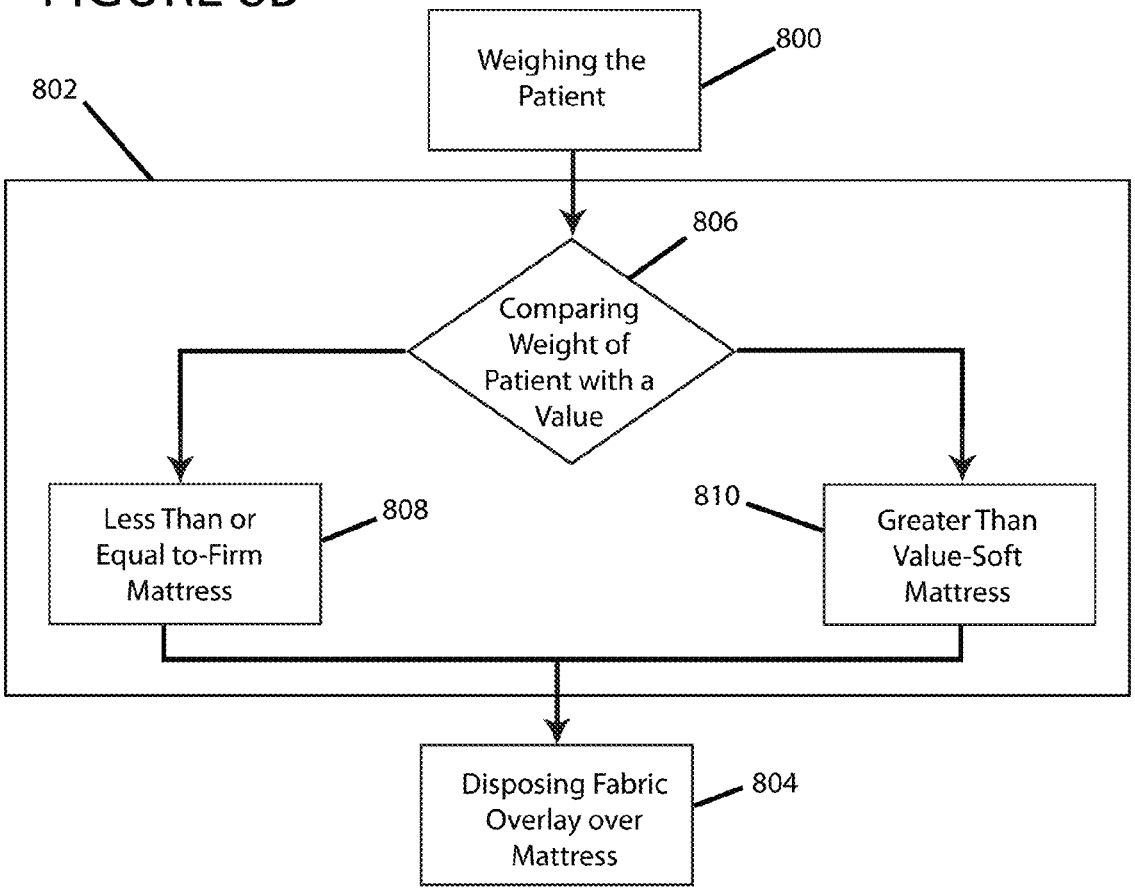

Present examples of the invention also can provide a method of treating the back pain of a patient, as illustrated in FIGS. 8A and 8B. The method can include the steps of weighing the patient (Step 800), selecting a firmness of a mattress based on the patient's weight (Step 802), and disposing a three-dimensional fabric overlay over the mattress for use by the patient (Step 804). To select the mattress, it can be determined if the weight of the patient corresponds to a value (Step 806) and if the weight is less than or equal to the value, a firm mattress is selected (Step 808), and selecting a soft mattress if the weight is greater than the value (Step 810). In an example, the value can be approximately 80 Kg.

The three-dimensional fabric overlay can include an upper layer, a lower layer, and monofilaments disposed between the upper layer and the lower layer. Further, the overlay can have pores in the upper layer that allow moisture to travel through the pores from the upper layer to the lower layer, and away from the patient. A plurality air spaces can be provided between the upper layer, the lower layer and the plurality of monofilaments and the plurality of air spaces can be allowed to partially collapse under the weight of the patient. In an example, the plurality of air spaces can be prevented from fully collapsing by at least providing rigid monofilaments. The monofilaments can have a length of approximately 8 mm to 14 mm, and in one example, approximately 9 mm.

The three-dimensional fabric overlay can have a weight of about 800 g to 850 g and can be removed and replaced over the mattress. In certain configurations, the three-dimensional fabric overlay is disposed only over a top of the mattress, or approximately an entire portion of the top of the mattress.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

I claim:

1. A method of treating at least one of sub-chronic or chronic lower back pain of a patient, using a mattress and a three-dimensional fabric overlay having an upper layer, a lower layer, a plurality of monofilaments disposed between the upper layer and the lower layer, and a plurality pores in the upper layer, comprising the steps of:

first, weighing the patient;

second, selecting a firmness of a mattress based on the patient's weight and an area density of the three-dimensional fabric overlay based on the plurality of monofilaments, comprising the steps of:

determining if the weight of the patient corresponds to a value;

if the weight is less than or equal to the value, then selecting a mattress with a first firmness;

and if the weight is greater than the value, then selecting a mattress with a second firmness;

wherein the first firmness is more firm than the second firmness; and third, disposing the three-dimensional fabric overlay over the mattress for use by the patient, wherein the method of treatment results in approximately 50% reduction in pain when used over the course of a month.

2. The method of claim 1, wherein the value is approximately 80 Kg.

3. The method of claim 1, further comprising the step of:

selecting the three-dimensional fabric overlay to comprise at least one of an area density of approximately 525 $g/m^2$ and a thickness of about 8 mm to about 15 mm.

4. The method of claim 1, further comprising the step of allowing moisture to travel through the pores from the upper layer to the lower layer, away from the patient.

5. The method of claim 1, further comprising the steps of:

providing a plurality air spaces between the upper layer, the lower layer and the plurality of monofilaments; and allowing the plurality of air spaces to partially collapse under the weight of the patient.

6. The method of claim 5, further comprising:

preventing the plurality of air spaces from fully collapsing.

7. The method of claim 6, wherein the preventing step comprises:

providing rigid monofilaments.

8. The method of claim 7, wherein the monofilaments have a length of approximately 8 mm to 14 mm.

9. The method the claim 8, wherein the length is approximately 9 mm.

10. The method of claim 1, wherein the three-dimensional fabric overlay has a weight of about 800 g to about 850 g.

11. The method of claim 1, wherein the three-dimensional fabric overlay is removably disposed over the mattress.

12. The method of claim 1, wherein the three-dimensional fabric overlay is disposed only over a top of the mattress.

13. The method of claim 12, wherein the three-dimensional fabric overlay is disposed over approximately an entire portion of the top of the mattress.

14. The method of claim 1, further comprising the steps of:

selecting the plurality of monofilaments from the group comprising:

wherein the plurality of monofilaments are polyethersulfone, or wherein the plurality of monofilaments comprise a monofilament diameter between about 0.10 mm to about 0.14 mm.

* * * * *